US005770824A

United States Patent [19]

Tsai et al.

[11] Patent Number: 5,770,824

[45] Date of Patent: Jun. 23, 1998

[54] KEY SWITCH ARRANGEMENT FOR NOTEBOOK COMPUTERS

[75] Inventors: Ching-Cheng Tsai, Keelung; Wen-To Chuo; Fu-Jen Hsu, both of Taipei Hsien, all of Taiwan

[73] Assignee: Chicony Electronics Co., Ltd., Taipei Hsien, Taiwan

[21] Appl. No.: 746,908

[22] Filed: Nov. 19, 1996

[51] Int. Cl.[6] ..... H01H 13/70

[52] U.S. Cl. ..... 200/5 A; 200/344

[58] Field of Search ..... 200/5 A, 512–517, 200/553, 557, 292, 293–307, 315, 316, 339, 341–345

[56] References Cited

U.S. PATENT DOCUMENTS 5,278,371 1/1994 Watanabe et al. ..... 200/344
5,504,283 4/1996 Kako et al. ..... 200/5 A
5,555,971 9/1996 Takada et al. ..... 200/344 X

*Primary Examiner*—J. R. Scott
*Attorney, Agent, or Firm*—Morton J. Rosenberg; David I. Klein; Jun Y. Lee

[57] ABSTRACT

A key switch for notebook computers, including a bottom frame having two pairs of upright lugs spaced near two opposite sides, a membrane circuit mounted on the bottom frame, a key cap, a rubber cone supported on the membrane circuit and compressed by the key cap to trigger the membrane circuit in producing an electrical signal, a first link having an annular base and two pairs of springy extension rods respectively extended from the periphery of the annular base at two opposite sides and respectively coupled to the key cap and the bottom frame diagonally, and a substantially U-shaped second link pivotably connected to the annular base of the first link at two opposite sides and coupled between the key cap and the bottom frame diagonally for turning relative to the first link to guide the movement of the key cap vertically.

3 Claims, 10 Drawing Sheets

KEY SWITCH ARRANGEMENT FOR NOTEBOOK COMPUTERS

BACKGROUND OF THE INVENTION

The present invention relates to a key switch for notebook computers, and more particularly to such a key switch which is easy to assemble, and can be smoothly and positively operated.

FIG. 1 shows a key switch for notebook computers according to the prior art. This structure of prior art key switch 10*a* is comprised of a key cap 11*a*, a rubber cone 12*a*, a first link 13*a*, a second link 14*a*, a membrane circuit 15*a*, and a bottom frame 16*a*. The first link 13*a* and the second link 14*a* are pivotably connected into a crossed linkage coupled between the key cap 11*a* and the bottom frame 16*a*. When the key cap 11*a* is depressed, the rubber cone 12*a* is compressed to trigger the membrane circuit 15*a*, causing it to produce an electrical signal. On the contrary, when the key cap 11*a* is released from the hand, the rubber cone 12*a* immediately returns to its former shape, and therefore the membrane circuit 15*a* is switched off. This structure of key switch is complicated to assemble because a big number of screws shall be used to fix the rubber cone 12*a*, the membrane circuit 15*a* and the bottom frame 16*a* together. When the key switch is operated, the links 13*a*, 14*a* tend to be forced to vibrate by the sharp edges of the link mounting holes 17*a*, 18*a* of the bottom frame 16*a*. Another drawback of this structure of key switch is that the key cap 11*a* tends to oscillate when it is moved vertically, because the link mounting holes 18*a* to which the first link 13*a* is slidably coupled are oblong holes respectively sloping in one direction. Still another drawback of this structure of key switch is that the key cap 11*a* tends to be damaged when it is forced into engagement with respective pivot pins 19*a*, 20*a* of the links 13*a*, 14*a*. Because the links 13*a*, 14*a* are rigid and not deformable, the pivot pins 19*a*, 20*a* of the links 13*a*, 14*a* cannot be respectively squeezed inwards for coupling to the respective coupling portions of the key cap 11*a* conveniently. Still another drawback of this structure of key switch is that the rubber cone tends to deviate from course when it is compressed, thereby causing a malfunction. Furthermore, when the key switch is operated, heat cannot be quickly carried away.

SUMMARY OF THE INVENTION

The present invention has been accomplished to provide a key switch for notebook computers which eliminates the aforesaid drawbacks. According to one aspect of the present invention, the key switch is comprised of a bottom frame, a key cap, a membrane circuit supported on the bottom frame, a rubber cone supported on the membrane circuit, a first link and a second link pivotably connected together and coupled between the key cap and the bottom frame to guide the movement of the key cap vertically, wherein the first link has an annular base and two pairs of springy extension rods respectively symmetrically extended from the periphery of the annular base at two opposite sides and respectively coupled to the key cap and the bottom frame diagonally. Because the two pairs of springy extension rods are symmetrically raised from the annular base at two opposite sides, the first link can be coupled between the key cap and the bottom frame in either direction. According to another aspect of the present invention, the second link has a substantially U-shaped configuration comprised of two parallel frame rods pivotably coupled to the annular base of the first link at two opposite sides, and a transverse connecting rod connected between the frame rods at one end, wherein each frame rod has an arched middle section in the middle disposed in contact with the periphery of the annular base of the first link to smooth the relative movement between the first link and the second link. According to still another aspect of the present invention, the first link has a pair of pivot pins pivotably coupled to pivot holes in respective upright lugs of the bottom frame, the second link has a pair of pivot pins slidably coupled to horizontal oblong holes in respective upright lugs of the bottom frame. According to still another aspect of the present invention, the transverse connecting rod of the first link has a springy arched section in the middle so that the first link can be deformed for easy installation. According to still another aspect of the present invention, the rubber cone has bottom ventilation grooves and through holes, the bottom frame has through holes, and the membrane circuit has punch holes respectively provided for dissipation of heat quickly. According to still another aspect of the present invention, the key cap has ventilation grooves at the bottom for exhaust of air, therefore the key cap will not be adhered to the rubber cone when it is depressed.

BRIEF DESCRIPTION OF THE DRAWINGS

FIG. As a side plain view of a key switch for notebook computers according to the prior art;

FIG. 3Ba is an enlarged view of a portion of FIG. 3B showing the structural relationship of the transverse connecting rod with respect to the flat base of the rubber cone;

DETAILED DESCRIPTION OF THE PREFERRED EMBODIMENT

Figure 1:
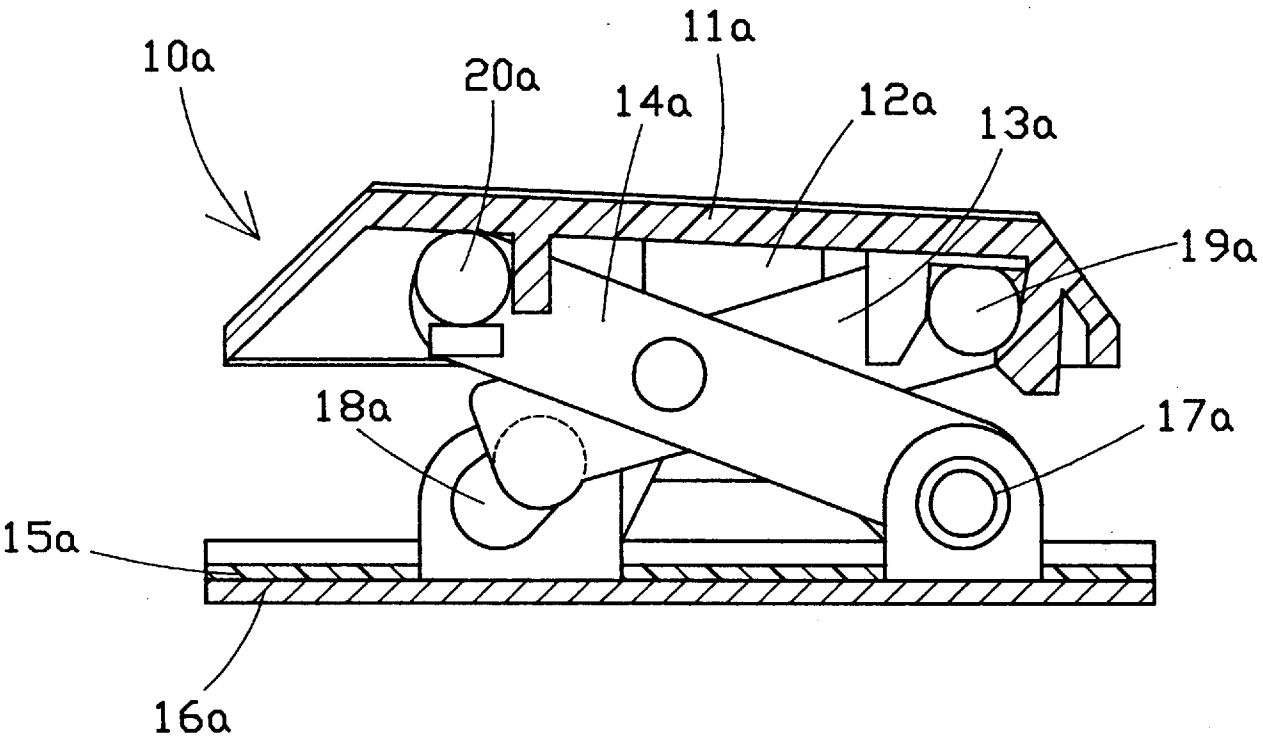
FIG. 1 (PRIOR ART)
Figure 2:
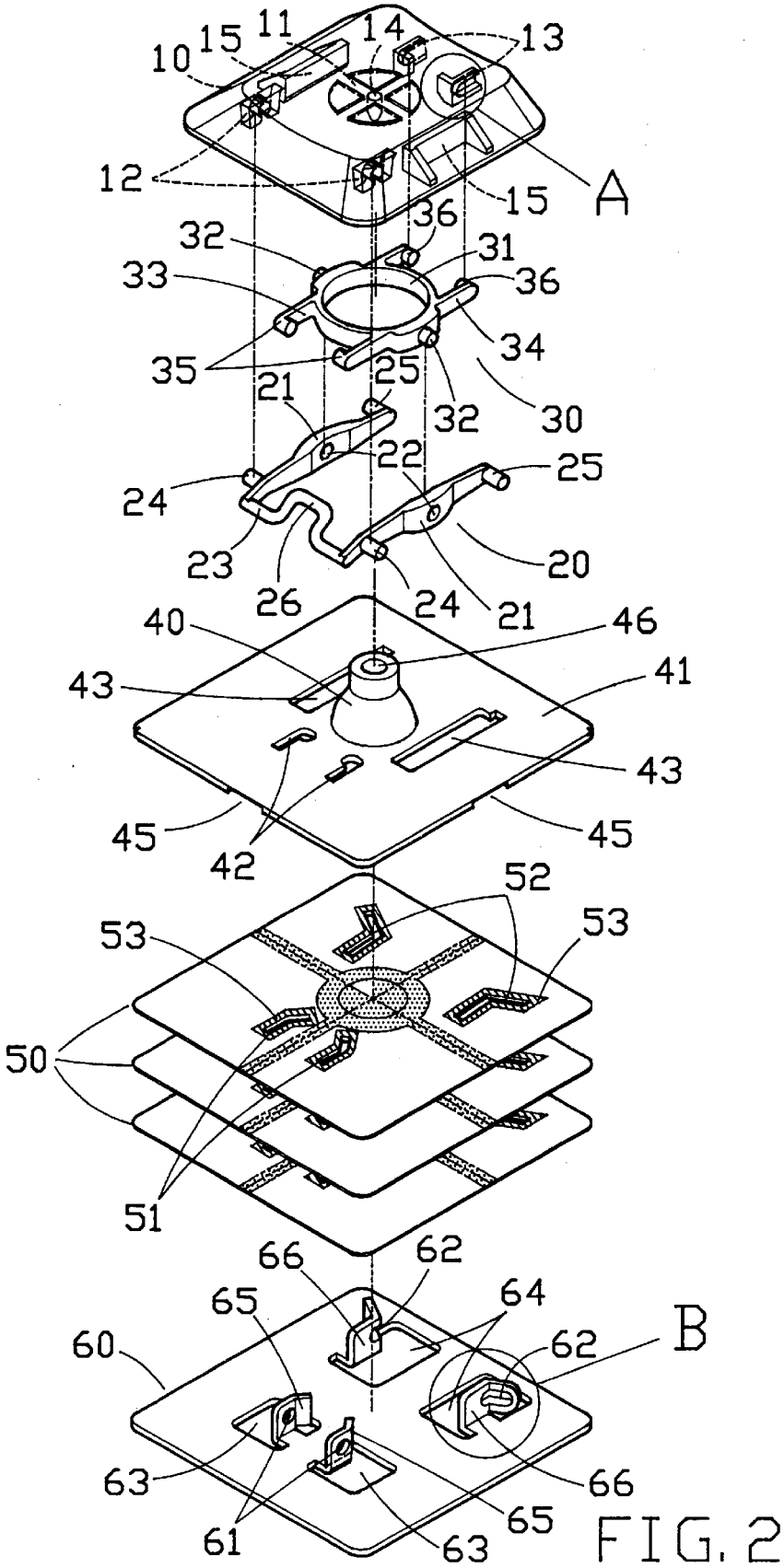
FIG. 2 is an exploded view of a key switch for notebook computers according to the present invention.
Figure 2B:
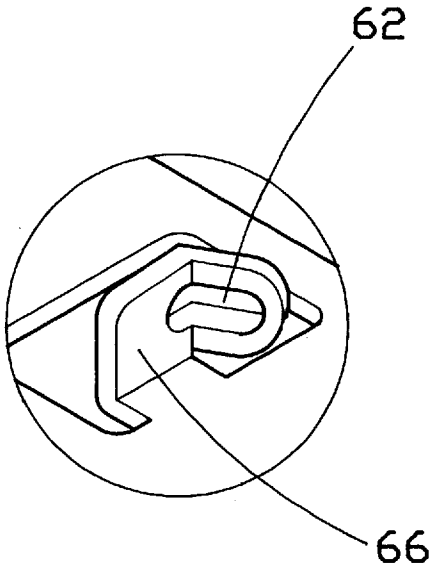
FIG. 2B is an enlarged view of portion of the bottom frame of FIG. 2.
Figure 2A:
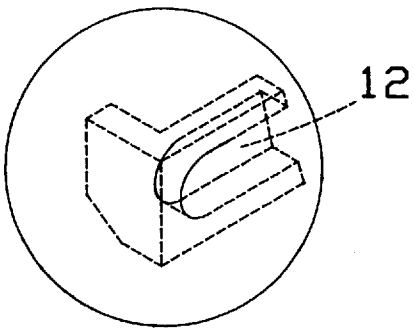
FIG. 2A is an enlarged view of portion of the key cap of FIG. 2.

Referring to FIGS. 2, 3A, 4A, and 5, a key switch in accordance with the present invention is generally comprised of a key cap 10, a first link 20, a second link 30, a rubber cone 40, a membrane circuit 50, and a bottom frame 60.

The key cap 10 has a substantially rectangular shape, a downward plunger 14 perpendicularly downwardly raised from the center at the bottom, a plurality of radial ventilation grooves 11 disposed at the bottom and spaced around the plunger 14, two symmetrical hooks 12 bilaterally raised from the bottom and disposed adjacent to one side, two symmetrical axle housings 13 bilaterally raised from the bottom and disposed adjacent to one side remote from the downward hooks 12, and two guide grooves symmetrically disposed at the bottom near two opposite sides and spaced between the hooks 12 and the axle housings 13.

The first link 20 is coupled to the key cap 10 at the bottom, comprising two parallel frame rods 21 and a transverse connecting rod 23 connected between the parallel frame rods 21 at one end. Each of the parallel frame rods 21 comprises a first pivot pin 24 perpendicularly and outwardly raised from one end adjacent to the transverse connecting rod 23, a second pivot pin 25 perpendicularly and outwardly raised from an opposite end remote from the transverse connecting rod 23, and a pivot hole 22 in the middle spaced between the pivot pins 24, 25. The transverse connecting rod 23 has an arched springy middle section 26.

The second link 30 is coupled to the key cap 10 at the bottom, comprising an annular base 31, two first pivot pins 32 perpendicularly raised from the periphery of the annular base 31 at two opposite sides in transverse direction (in parallel to the transverse connecting rod 23 of the first link 20), a first pair of parallel springy extension rods 33 and a second pair of parallel springy extension rods 34 bilaterally perpendicularly raised from the periphery of the annular base 31 at two opposite sides in longitudinal direction (in parallel to the frame rods 21 of the first link 20), two second pivot pins 35 respectively and perpendicularly raised from the first pair of parallel springy extension rods 33 at one end remote from the annular base 31 and facing each other, and two third pivot pins 36 respectively and perpendicularly raised from the second pair of parallel springy extension rods 34 at one end remote from the annular base 31 and facing each other.

The rubber cone 40 is disposed below the first link 20 and the second link 30 at the bottom, having a recessed top hole 46 adapted for receiving the plunger 14 of the key cap 10, a downward triggering rod 44 suspended from the bottom below the recessed top hole 46 and spaced above the center hole 47 at the center of the flat base 41 of the rubber cone 40, a plurality of through holes 42, 43 through the flat base 41, and a plurality of ventilation grooves 45 at the bottom of the flat base 41.

The membrane circuit 50 is a multi-layer membrane circuit supported between the bottom frame 60 and the rubber cone 40, having a plurality of punch holes 51, 52 peripherally sealed with a bonding resin 53.

The bottom frame 60 supports the membrane circuit 50, comprising two first upright lugs 65 which define a respective axle hole 61 adapted for coupling the second link 30, two second upright lugs 66 which define a respective horizontal oblong hole 62 adapted for coupling the first link 20, and a plurality of vertical through holes 63 for ventilation.

The assembly process of the key switch is outlined hereinafter with reference to FIGS. 5A, 5B, 5C, and 5D. The membrane circuit 50 and the rubber cone 40 are mounted on the bottom frame 60 at the top in proper order, permitting the upright lugs 65, 66 to be inserted through the punch holes 51, 52 of the membrane circuit 5 and the through holes 42, 43 of the flat base 41 of the rubber cone 40 (see FIG. 5A), then the second pivot pins 35 of the second link 30 are respectively inserted into the axle holes 61 of the first upright lugs 65 of the bottom frame 6 (see FIG. 5B), and then the second pivot pins 25 of the first link 20 are respectively inserted into the oblong holes 62 of the second upright lugs 66, and then the first link 20 is pivotably coupled to the second link 30 by forcing the first pivot pins 32 of the second link 30 into the pivot holes 22 of the first link 20 (see FIG. 5C), and then the key cap 10 is coupled to the first link 20 and the second link 30 by: coupling the hooks 12 and axle housings 13 of the key cap 10 to the first pivot pins 24 of the first link 20 and the third pivot pins 36 of the second link 30 respectively (see FIG. 5D).

Figure 3A:
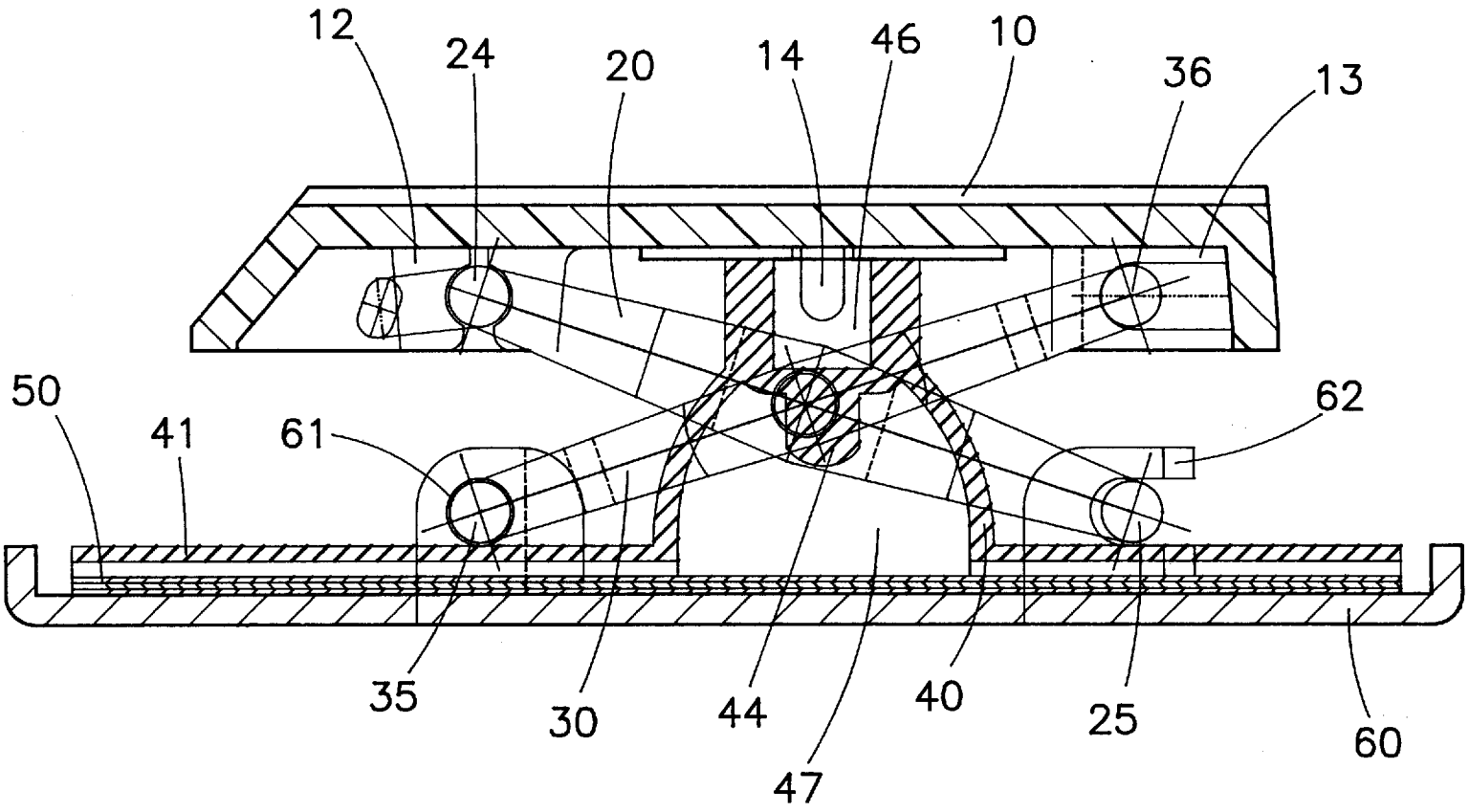
FIG. 3A is a side plain view of the key switch according to the present invention.
Figure 3B:
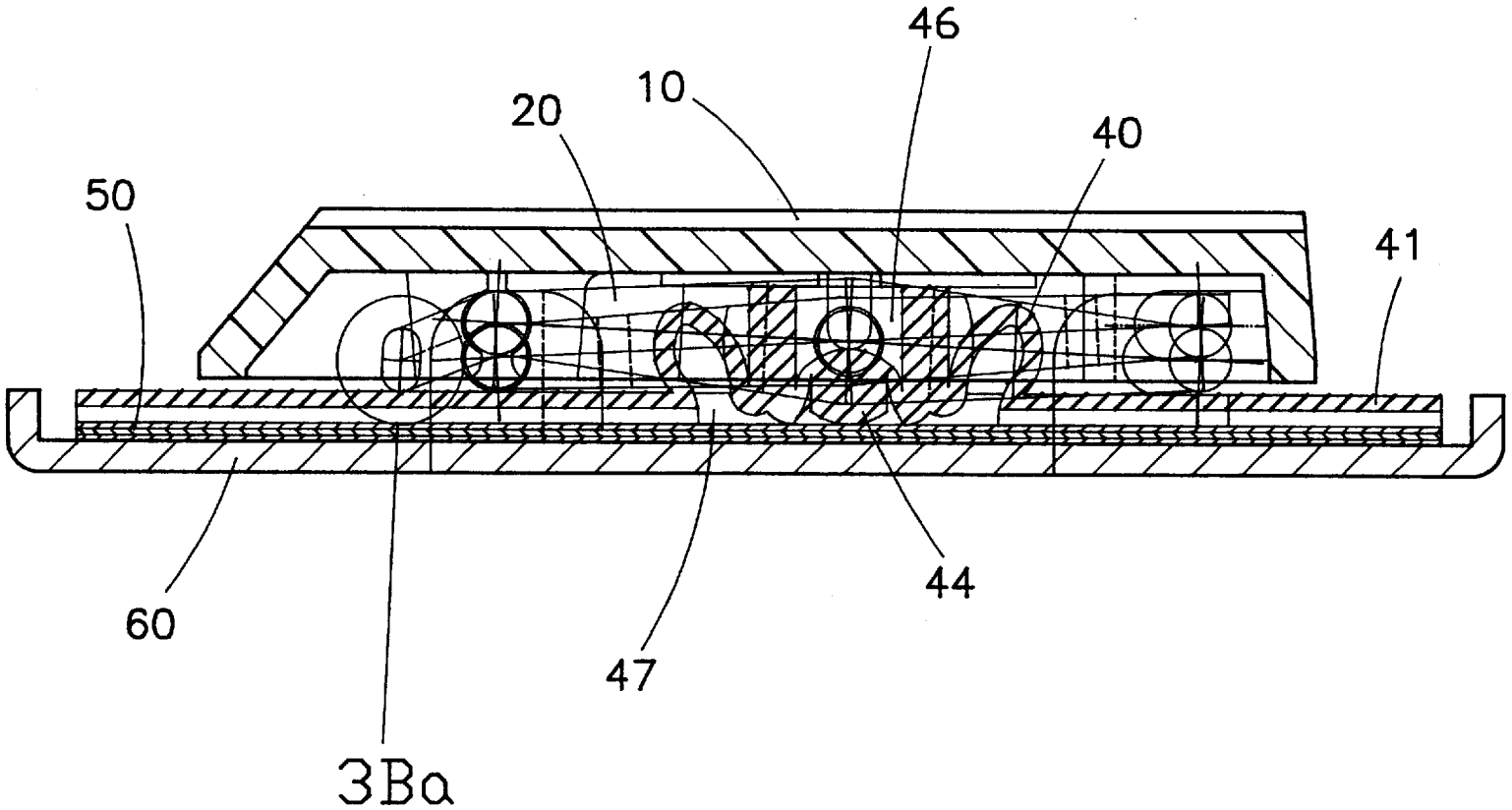
FIG. 3B is similar to FIG. 3A but showing the key cap depressed, and the rubber cone compressed.
Figure 3B:
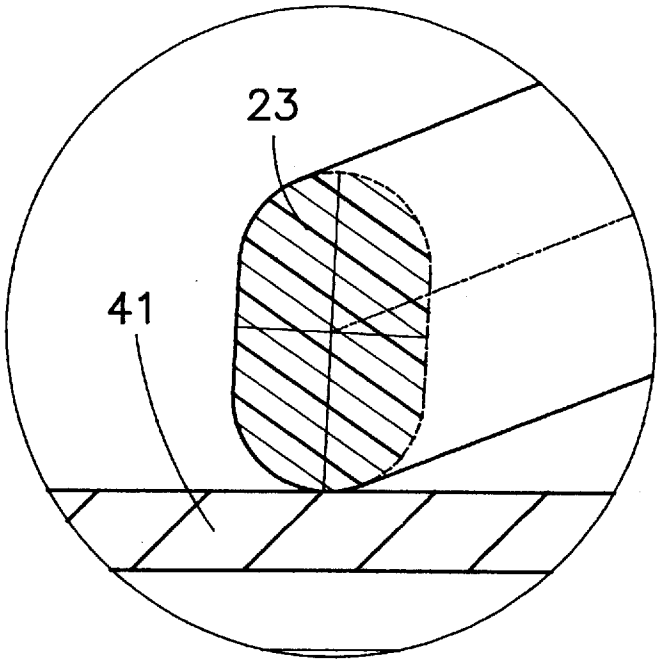
Figure 4A:
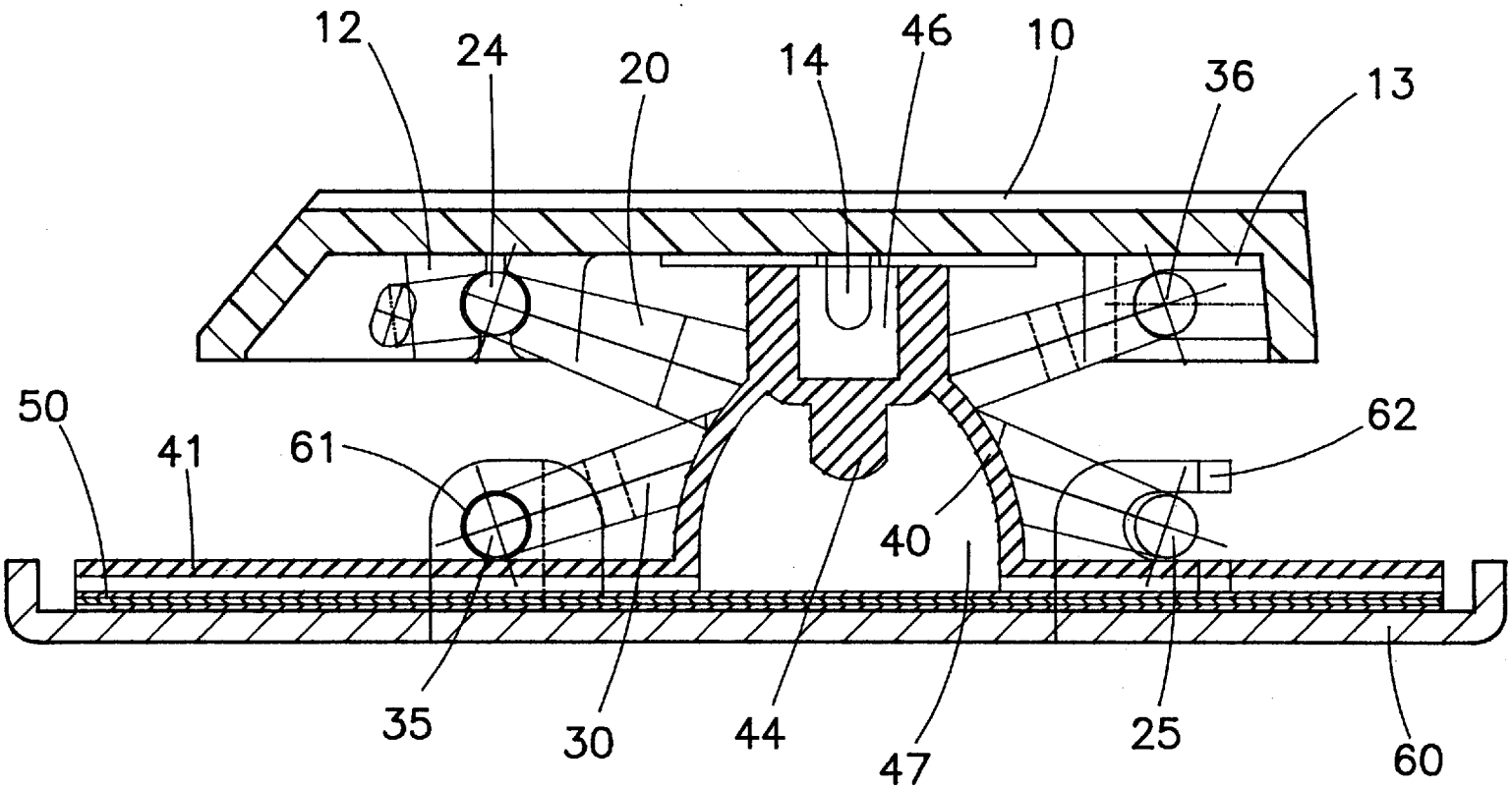
FIG. 4A is another side plain view of the key switch according to the present invention.
Figure 4B:
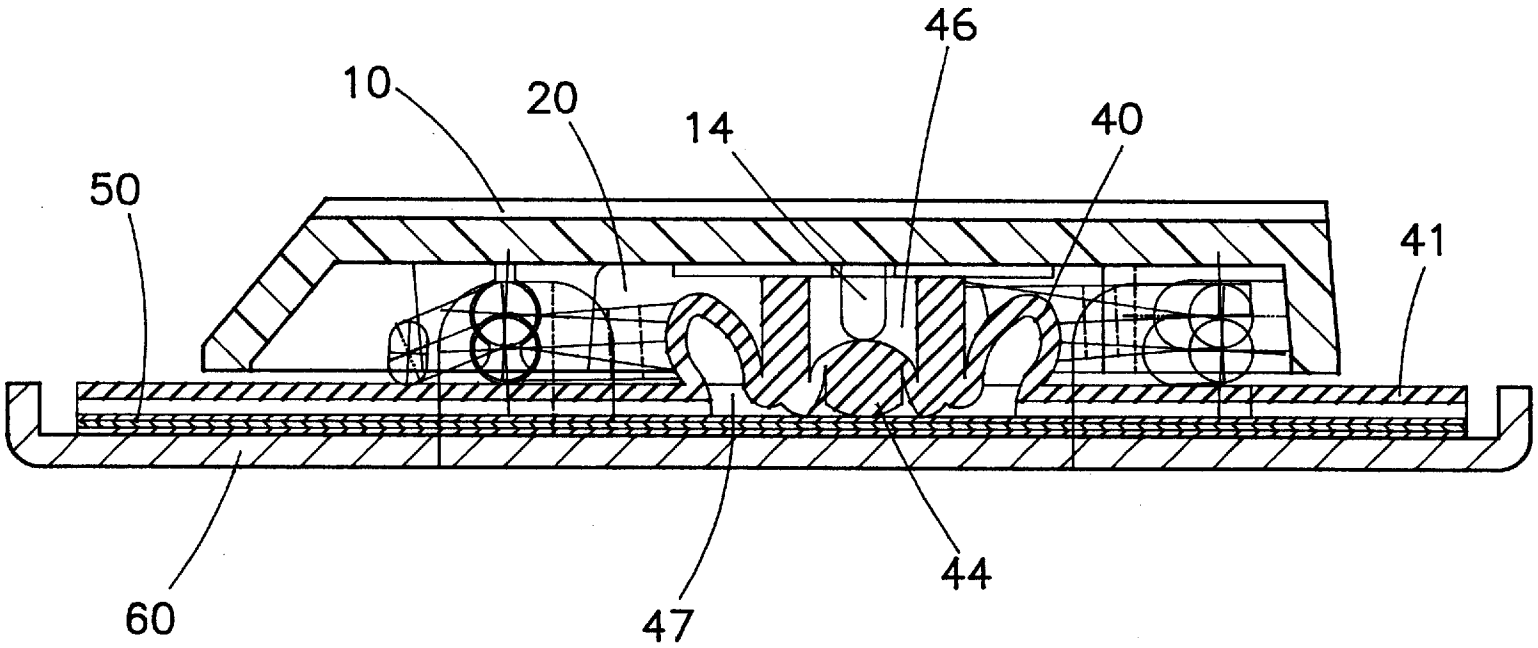
FIG. 4B is similar to FIG. 3B but showing the key depressed, and the rubber cone compressed.
Figure 5B:
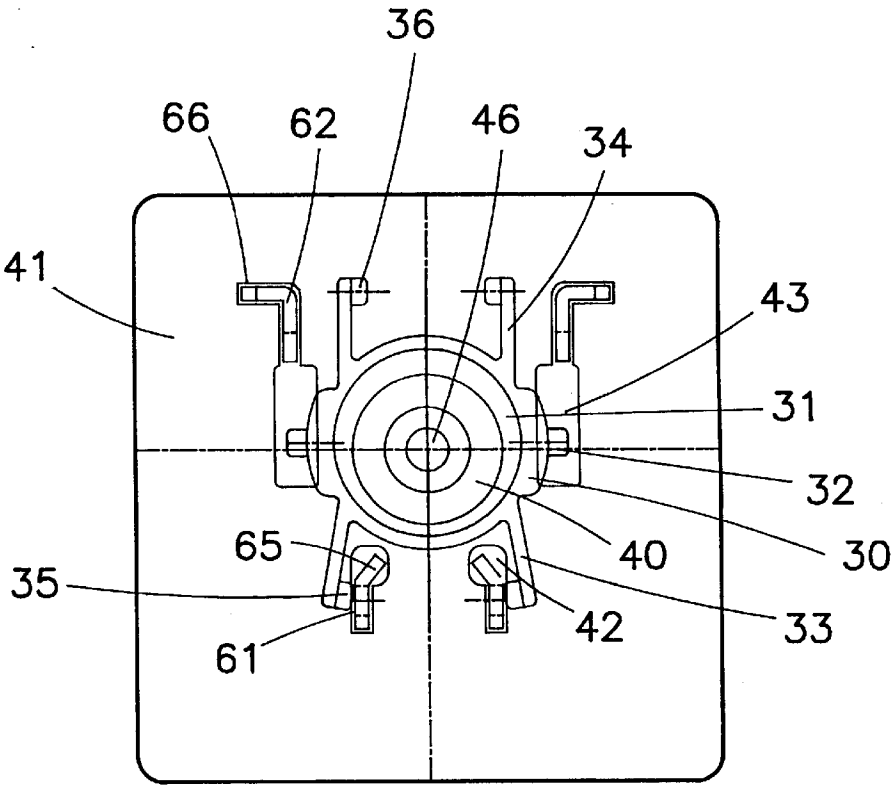
FIG. 5B is top plain view showing the rubber cone and the second link coupled to the bottom frame according to the present invention.
Figure 5A:
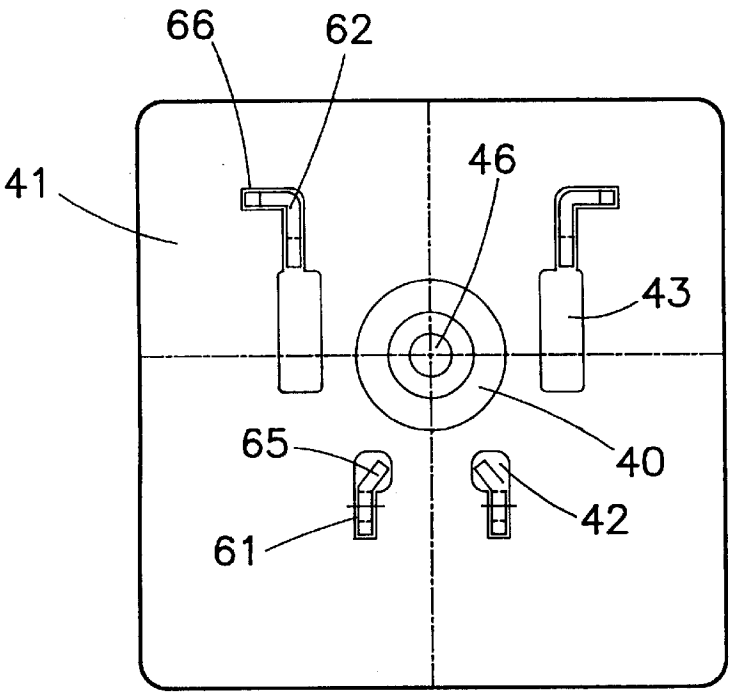
FIG. 5A is a top plain view showing the rubber cone coupled to the bottom frame according to the present invention.
Figure 5D:
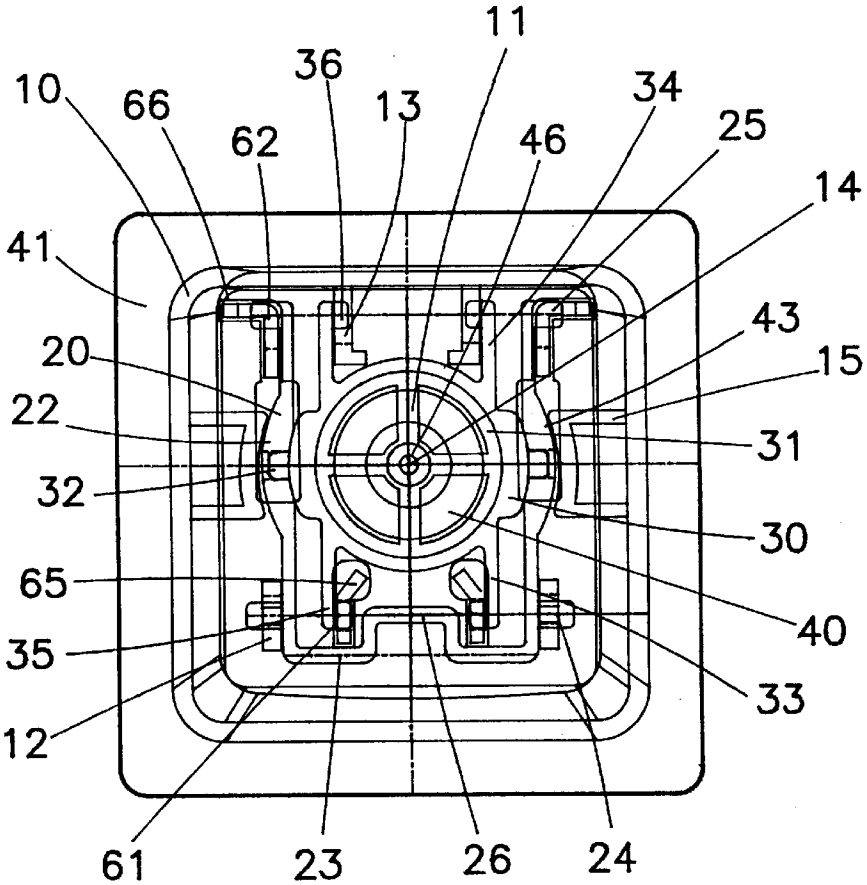
FIG. 5C is a top plain view showing the rubber cone, the first link and the second link respectively coupled to the bottom frame according to the present invention; and, FIG. 5D is a top plain view showing the key switch of the present invention assembled.
Figure 5C:
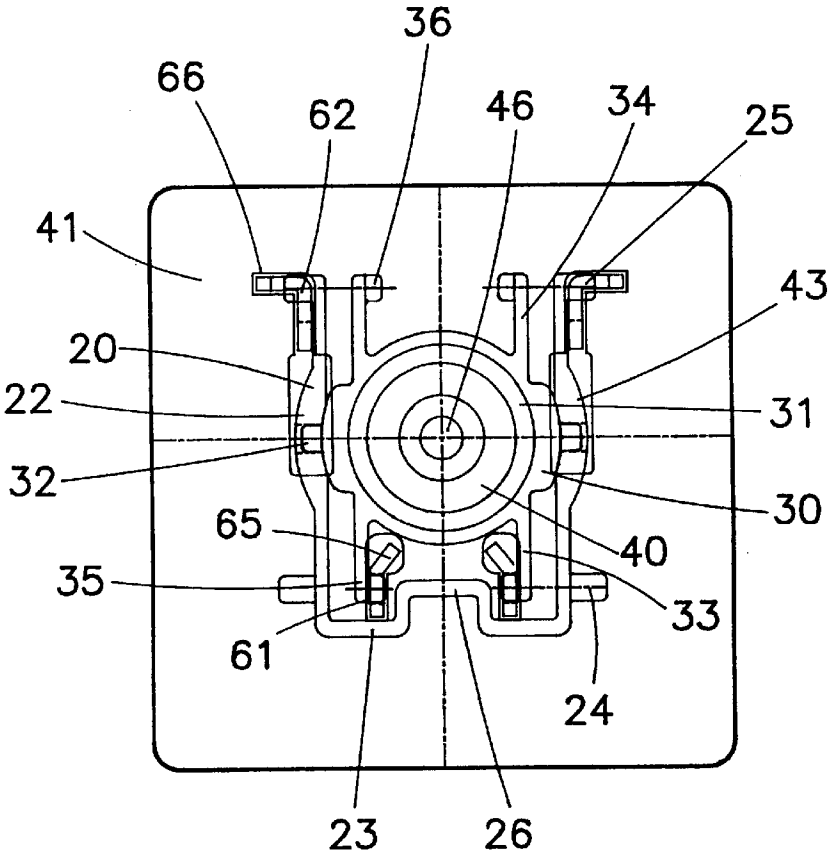

Referring to FIGS. 3A, 3B, 4A, and 4B, when the key cap 10 is depressed, the links 20, 30 are turned relative to each other to guide the downward movement of the key cap 10 smoothly, and at the same time the downward triggering rod 44 of the rubber cone 40 is forced by the plunger 11 of the key cap 10 to trigger the membrane circuit 50, and therefore the key switch is switched on (see FIGS. 3B and 4B). When the key cap 10 is released from the hand, the rubber cone 40 immediately returns to its former shape, thereby causing the links 20, 30 to be turned relative each other reversely, and therefore the key cap 10 is returned to its former position. When the rubber cone 40 returns to its former shape, the triggering rod 44 of the rubber cone 40 is disconnected from the membrane circuit 50, and therefore the key switch is switched off (see FIGS. 3A and 4A).

Because of the design of the through holes 42, 43, 63, 64 in the flat base 41 of the rubber cone 40 and the bottom frame 60 and the punch holes 51, 52 in the membrane circuit 50, head can be quickly carried away from the key switch during the operation. The design of the ventilation grooves 11 of the key cap 10 prevents the key cap 10 from being adhered to the rubber cone 40 after the key cap 10 has been depressed. When the key cap 10 is moved to the lower limit position, the transverse connecting rod 23 of the first link 20 will touch the top side of the flat base 41 of the rubber cone 40, to prevent from making a noise (see FIG. 3B). The frame rods 21 of the first link 20 have a respective arched middle portion disposed in contact with the periphery of the annular base 31 of the second link 30, therefore the contact area between the first link 20 and the second link 30 is greatly increased, and the relative movement between the first link 20 and the second link 30 is stable. Because the oblong holes 62 of the second upright lugs 66 of the bottom frame 60 are horizontal holes, the key cap 10 can be maintained balanced when it is moved up and down. The direction-free design of the second link 30 permits the second link 30 to be quickly installed without worrying about its installation direction. Because the springy extension rods 33, 34 of the second link 30 are deformable, the pivot pins 35, 36 can be squeezed inwards for coupling to the pivot holes 61 of the bottom frame 60 and the axle housings 13 of the key cap 10 conveniently. The springy power of the springy extension rods 33, 34 of the second link 30 and the arched springy section 26 of the first link 20 can absorb shocks, to prevent the key cap 10 from being damaged. The arched springy section 26 of the first link 20 facilitates the connection of the first pivot pins 24 of the first link 20 to the hooks 12 of the key cap 10. Further, the first upright lugs 65 are rigid and have a substantially angled configuration adapted for matching with the deformable structure of the second link 30, so that the second link 30 can be conveniently coupled to the bottom frame 60 without the assistance of any tools or the use of screws. The second upright lugs 66 of the bottom frame 60 are also rigid and have a substantially angled configuration. The angled design of the second upright lugs 66 reinforces their structural strength. As the plunger 14 of the key cap 10 is suspended in the recessed top hole 46 of the rubber cone 40, the trigger rod 44 of the rubber cone 40 can be positively downwardly compressed by the key cap 10 to positively trigger the membrane circuit 50 (see FIG. 4B).

It is to be understood that the drawings are designed for purposes of illustration only, and are not intended as a definition of the limits and scope of the invention disclosed.

What the invention claimed is:

1. A key switch comprising:

a key cap, said key cap comprising a bottom side, a downward plunger perpendicularly downwardly raised from the bottom side at the center, a plurality of radial ventilation grooves disposed at the bottom side and spaced around said plunger, two symmetrical pairs of downward hooks and two symmetrical axle housings bilaterally raised from the bottom side;

a bottom frame, said bottom frame comprising two first upright lugs which have an angled configuration and define a respective horizontal axle hole, two second upright lugs which have an angled configuration and define a respective horizontal oblong hole, and a plurality of vertical through holes respectively disposed around said first upright lugs and said second upright lugs;

a membrane circuit supported on said bottom frame, said membrane circuit having a plurality of punch angled holes through which the first upright lugs and second upright lugs of said bottom frame pass, said punch angled holes being respectively peripherally sealed with a layer of bonding resin;

a rubber cone mounted on said membrane circuit for pressing by the plunger of said key cap to trigger said membrane circuit in producing an electrical signal, said rubber cone comprising a flat base having a center hole, and a plurality of through holes through which the first upright lugs and second upright lugs of said bottom frame pass, a cone body raised from the periphery of the center hole of said flat base and having a downward trigger rod suspended on the inside spaced above the center hole of said flat base;

a first link coupled between said key cap and said bottom frame, comprising two parallel frame rods and a transverse connecting rod connected between said parallel frame rods at one end, each of said parallel frame rods comprising a first pivot pin perpendicularly and outwardly raised from one end adjacent to said transverse connecting rod and pivoted to one hook of said key cap, a second pivot pin perpendicularly and outwardly raised from an opposite end remote from said transverse connecting rod and slidably inserted into the horizontal oblong hole of one second upright lug of said bottom frame, and a pivot hole in the middle, said transverse connecting rod having an arched springy middle section; and, a second link coupled between said key cap and said bottom frame, said second link comprising an annular base, two first pivot pins perpendicularly raised from the periphery of said annular base at two opposite sides in transverse direction and respectively inserted into the pivot holes of the two frame rods of said first link, a first pair of parallel springy extension rods and a second pair of parallel springy extension rods bilaterally perpendicularly raised from the periphery of said annular base at two opposite sides in longitudinal direction, two second pivot pins respectively and perpendicularly raised from said first pair of parallel springy extension rods at one end remote from said annular base and respectively inserted into the pivot holes of the first upright lugs of said bottom frame, and two third pivot pins respectively and perpendicularly raised from said second pair of parallel springy extension rods at one end remote from said annular base and respectively pivoted to the axle housings of said key cap.

2. The key switch of claim 1 wherein the flat base of said rubber cone has a plurality of ventilation grooves at a bottom side respectively extended from the center hole of said flat base and facing said membrane circuit.

3. The key switch of claim 1 wherein said key cap has a plurality of guide grooves at the bottom side for guiding said key cap into coupling with said first link and said second link.

* * * * *